US006793422B2

(12) United States Patent
Kurashina

(10) Patent No.: US 6,793,422 B2
(45) Date of Patent: Sep. 21, 2004

(54) PRINTING APPARATUS FOR PRINTING CHARACTERS ON A TAPE IN A SIZE DETERMINED BY TAPE USE

(75) Inventor: Hiroyasu Kurashina, Matsumoto (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 0 days.

(21) Appl. No.: 10/411,883

(22) Filed: Apr. 11, 2003

(65) Prior Publication Data

US 2003/0219300 A1 Nov. 27, 2003

(30) Foreign Application Priority Data

Apr. 22, 2002 (JP) ..... 2002-118766

(51) Int. Cl.[7] ..... B41J 11/26; B41J 5/30; B41J 21/17; B41J 11/44

(52) U.S. Cl. ..... 400/615.2; 400/61; 400/70; 400/76

(58) Field of Search ..... 400/615.2, 61, 400/70, 76, 613; 101/288, 693; 358/1.11

(56) References Cited

U.S. PATENT DOCUMENTS 4,321,670 A * 3/1982 Timmons ..... 707/200
5,559,934 A * 9/1996 Ogura et al. ..... 358/1.18
5,562,353 A * 10/1996 Handa et al. ..... 400/615.2
5,772,342 A * 6/1998 Yamamoto et al. ..... 400/615.2
5,933,589 A * 8/1999 Hidaka et al. ..... 358/1.18
6,092,946 A * 7/2000 Cockerill et al. ..... 400/613
6,115,024 A * 9/2000 Hayama ..... 345/23
6,152,623 A * 11/2000 Palmer et al. ..... 400/208
6,340,255 B1 * 1/2002 Konishi et al. ..... 400/615.2
6,375,306 B1 * 4/2002 Tsukagoshi ..... 347/40
6,381,027 B1 * 4/2002 Tanaka ..... 358/1.11
6,491,461 B1 * 12/2002 Nakajima et al. ..... 400/693
6,496,275 B1 * 12/2002 Kurashina et al. ..... 358/1.11
6,550,994 B2 * 4/2003 Manduley ..... 400/611
6,594,026 B2 * 7/2003 MacDonald ..... 358/1.12
6,666,593 B2 * 12/2003 Akaiwa ..... 400/61

FOREIGN PATENT DOCUMENTS

JP 11-167345 * 6/1999 ..... G09F/3/02

* cited by examiner

*Primary Examiner*—Andrew H. Hirshfeld
*Assistant Examiner*—Wasseem H. Hamdan
(74) *Attorney, Agent, or Firm*—Hogan & Hartson, LLP

(57) ABSTRACT

A printing apparatus for printing characters on a printing tape for use as a label to be adhered to an article for adhesion has a display for displaying characters inputted into the printing apparatus, a printer for printing the inputted characters on the printing tape, an automatic setting device for automatically setting a print size of the characters according to a tape width of a loaded printing tape, and selection setting device for selectively setting the print size of the characters from among a plurality of print sizes determined in stages. The selection setting device has a fixed-size setting device capable of selectively setting a specific print size corresponding to a selected concrete article for adhesion.

7 Claims, 11 Drawing Sheets

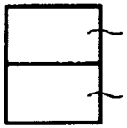

FIG. 5A

| LEVEL | LEVEL 1 | LEVEL 2 | LEVEL 3 | LEVEL 4 |
|---|---|---|---|---|
| TITLE | PARAGRAPH STYLE | SELECTED AT LEVEL 1 | SELECTED AT LEVEL 2 | SELECTED AT LEVEL 3 |
| OPTIONS | _LETTER SIZE | _AUTOMATIC | _EVEN<br>_EASY | (TO NEXT OPTION AT LEVEL 1) |
| | | _1 LINE | _■■SMALL 1a<br>_■■MEDIUM 1b<br>_■■LARGE 1c<br>_■■EXTRA LARGE 1d | (TO NEXT OPTION AT LEVEL 1) |
| | | | _■■FIXED WIDTH 1* | ■■FD BACK 1f (TO NEXT OPTION AT LEVEL 1)<br>■■MO BACK 1g<br>■■CD BOX 1h<br>■■MO BACK 1i<br>■■PENCIL 1j<br>(EXCLUSIVE SCREEN FOR INPUTTING NUMERIC VALUE) |
| | | _2 LINES | _■■THICK LARGE 2a<br>:<br>_■■THIN LARGE 2b | (TO NEXT OPTION AT LEVEL 1) |
| | | _3-8 LINES | (TO NEXT OPTION AT LEVEL 1) | |

FIG. 5B

| LEVEL | LEVEL 1 | LEVEL 2 | LEVEL 3 | LEVEL 4 |
|---|---|---|---|---|
| TITLE | PARAGRAPH STYLE | SELECTED AT LEVEL 1 | SELECTED AT LEVEL 2 | SELECTED AT LEVEL 3 |
| | __ALLOCATION | __■■FRONT ALIGNMENT<br>:<br>__■■REAR ALIGNMENT | (TO NEXT OPTION AT LEVEL 1)<br>(TO NEXT OPTION AT LEVEL 1) | |
| | __OUTER FRAME /TABLE | __NONE | | |
| | | __TABLE<br>: | (TO NEXT OPTION AT LEVEL 1) | |
| | __END? | *EFFECTIVE RANGE?<br>__THIS SENTENCE<br>__THIS PARAGRAPH | | (TO NEXT OPTION AT LEVEL 1) |

FIG. 6A

| LEVEL | LEVEL 1 | LEVEL 2 | LEVEL 3 | |
|---|---|---|---|---|
| TITLE | PARAGRAPH STYLE | SELECTED AT LEVEL 1 | SELECTED AT LEVEL 2 | |
| OPTIONS | __SPECIAL FORM | __HEADER/LONGITUDINAL | (SPECIAL EXCLUSIVE) | |
| | | __HEADER/TRANSVERSAL | (SPECIAL EXCLUSIVE) | |
| | | __LONGITUDINAL HORIZONTAL WRITING | (SPECIAL EXCLUSIVE) | |
| | | __TRANSVERSAL VERTICAL WRITING | (SPECIAL EXCLUSIVE) | |
| | | __FIXED WIDTH PRINTING | ■■FD BACK 1f | (SPECIAL EXCLUSIVE) |
| | | | ■■MO BACK 1g | (SPECIAL EXCLUSIVE) |
| | | | ■■CD BOX 1h | (SPECIAL EXCLUSIVE) |
| | | | ■■MD BACK 1i | (SPECIAL EXCLUSIVE) |
| | | | ■■PENCIL 1j | (SPECIAL EXCLUSIVE) |
| | __FORM | | | |
| | __FILE REGISTRATION | | | |
| | __FILE RETRIEVAL | | | |
| | __FILE DELETION | | | |
| | __FILE COPY | | | |

FIG. 6B

| STYLE | LETTER SIZE |
|---|---|
| ■■FD BACK 1f | 16 DOTS |
| ■■MO BACK 1g | 24 DOTS |
| ■■CD BOX 1h | 24 DOTS |
| ■■MD BACK 1i | 16 DOTS |
| ■■PENCIL 1j | 16 DOTS |

PRINTING APPARATUS FOR PRINTING CHARACTERS ON A TAPE IN A SIZE DETERMINED BY TAPE USE

BACKGROUND OF THE INVENTION

1. Field of the Invention

The present invention relates to a printing apparatus and, in particular, to a tape printer for printing characters on a printing tape, which is formed into a label to be adhered or attached to an object or an article (the article is hereinafter referred to as an article for adhesion), in which the printing is made based on characters inputted to the tape printer.

2. Description of the Related Art

In a conventional tape printer, a print size of characters (such as letters) to be printed is set as a relative value in accordance with detection of a tape width of a loaded printing tape.

In the existing printing tape used in tape printers, a printing tape with extremely narrow width for a label to be adhered to a back of a minidisk (MD) or a flexible disk does not exist. This is because even if a small label is created from the printing tape with a narrow width so as to be adhered to the specific article for adhesion, the handling thereof is difficult. That is, the extremely small label is difficult of handling in terms of holding the label, removing a backing paper (or a release paper) from the label, and attaching the label to the article for adhesion. Furthermore, a problem also arises in that the extremely small label after being adhered to the article for adhesion is likely to peel off easily. Moreover, the printing tape with a narrow width also has a problem in the ease of running or traveling of the tape at the time of printing. Therefore, there will arise a problem in that the smaller becomes the width of the tape, the more crooked becomes the printed path.

Therefore, there is considered an arrangement in which a printing tape with a larger width is folded to suit the article for adhesion and is adhered thereto. In this case, since the print size is set as a relative value of the tape width of the loaded printing tape in the conventional tape printer, the setting of the print size must be made while taking the tape width into account after a mode is switched from a print size setting mode to a manual input mode and, further, after the size of the article for adhesion is measured. Thus, a user is forced to conduct a complicated operation.

SUMMARY OF THE INVENTION

The present invention has been made in view of the fact that articles for adhesion requiring extremely narrow labels are virtually limited to several particular types, and has an advantage of providing a printing apparatus and, in particular, a tape printer which can set an appropriate print size for a particular article for adhesion easily without being influenced by a width of a loaded printing tape.

According to one aspect of the present invention, there is provided a printing apparatus for printing characters on a printing tape. The printing apparatus comprises: a display for displaying characters inputted into the printing apparatus; a printer for printing the inputted characters on the printing tape; a setting device for setting a print size of the characters according to a width of a loaded printing tape; and a selection setting device for selectively setting the print size of the characters from among a plurality of print sizes determined in stages, wherein the selection setting device comprises a fixed-size setting device for setting a specific print size depending on a use of the printing tape.

According to another aspect of the present invention, there is provided a tape printer for printing characters on a printing tape for use as a label to be adhered to an article for adhesion. The tape printer comprises: display means for displaying on a screen characters inputted into the tape printer; print means for printing the inputted characters on the printing tape; automatic setting means for automatically setting a print size of the characters according to a tape width of a loaded printing tape; and selection setting means for selectively setting the print size of the characters from among a plurality of print sizes determined in stages, wherein the selection setting means comprises fixed-size setting means capable of selectively setting a specific print size corresponding to an article for adhesion selected from among a plurality of concrete articles for adhesion.

According to the above arrangement, there are provided the automatic setting means for setting the print size of the characters according to the tape width of the loaded printing tape, and the selection setting means for selectively setting the print size of the characters from among a plurality of print sizes determined in stages. Therefore, a user can set the print size of the characters easily by using the automatic setting means or the selection setting means appropriately according to his/her purpose and preference. Furthermore, since the selection setting means includes the fixed-size setting means capable of selectively setting a specific print size corresponding to the selected article for adhesion, which is selected from among a plurality of concrete articles for adhesion, it is possible to set the print size suitable for the label of the concrete article for adhesion without being influenced by the width of the tape of the loaded printing tape. Specifically, it is possible to set the specific print size corresponding to the concrete article for adhesion easily and rapidly without being influenced by the width of the loaded printing tape by just selecting the concrete article for adhesion to which the created label is to be adhered, thus enabling enhancement of the convenience and the user-friendliness for the user. Furthermore, since the specific print size corresponding to the concrete article for adhesion can be set whatever tape width of the printing tape may be used, there can be created a label which corresponds to the concrete article for adhesion irrespective of the width of the loaded printing tape. Accordingly, even in case where the user creates the label for the concrete article for adhesion with a narrow width, he/she can create the label by using the printing tape with a wide width, which is easy to handle. When the created label is adhered, the tape having a large width is adhered in the folded manner to suit the concrete article for adhesion, thus making the adhered label difficult to be peeled off.

Preferably, the plurality of articles for adhesion includes media, cases for containing therein these media, and a pencil, the concrete media including those classified into a magnetic disk, an optical magnetic disk, an optical disk, and a memory card. The convenience and the user-friendliness for the user can thus be enhanced. Specifically, in creating the labels for the concrete media such as a magnetic disk, an optical magnetic disk, an optical disk and a memory card, and cases holding these media, as well as a pencil, the user can set the appropriate print size of the labels easily and rapidly without considering the tape width of the loaded tape width. As the concrete media having the necessity of frequently preparing labels therefor, there can be listed a flexible disk classified as the magnetic disk, a magnet optical disk and a mini disk classified as the optical magnetic disk, a compact disk (CD) classified as the optical disk, and the memory stick and the SmartMedia classified as the memory card. The above arrangement makes it easy to prepare labels for such media.

Preferably, the display means switches an input screen to an exclusive input screen corresponding to the concrete article for adhesion by mode switching to the fixed-size setting means.

According to this arrangement, when the concrete article for adhesion is selected by the fixed-size setting means and then the mode switching to the fixed-size setting means is made, the input screen can be switched to the exclusive input screen corresponding to the selected specific article for adhesion. Accordingly, the user can create the label while confirming the selected article for adhesion when the label for the specific article for adhesion is created. A mistake in label creation can thus be prevented.

Preferably, the specific print size corresponds to an end face of the concrete article for adhesion, and the print means is capable of printing a guide line corresponding to a width of the end face of the article for adhesion as well as the characters of the specific print size.

According to this arrangement, when the created label is adhered to the end face of the concrete article for adhesion, the guide line is used as the guide of the adhered position thereof. It is thus possible to adhere the label in an appropriate position without being tilted.

Preferably, the print means print the pictographic characters indicating the concrete article for adhesion as well as the characters of the specific print size.

According to this constitution, since the pictographic characters corresponding to the selected concrete article for adhesion are printed on the label together with the characters of the specific print size corresponding to the selected concrete article for adhesion, it is possible to easily create a highly expressive label according to the preferences of the user. Furthermore, when various types of the labels are created in succession, it is possible to judge which label should be adhered to which medium based on the printed content, thus preventing mistaken use of the label.

Preferably, the fixed-size setting means comprises a character number limiting means for limiting a number of the inputted characters depending on an available length of an adhesion area of the concrete article for adhesion.

According to this arrangement, since the number of the inputted characters is limited depending on the length of the available label adhesion area of the selected concrete article for adhesion, a mistake in label creation can be prevented when the label for the concrete article for adhesion is created. Accordingly, there can be prevented a mistake in that the label for the concrete article for adhesion is longer than the available label adhesion area of the target specific article for adhesion due to a large number of inputted characters.

Preferably, the character number limiting means notifies an error in the display means when the number of the letters of the inputted character exceeds the limitation.

According to this arrangement, the error notification is performed by the display means when the number of the inputted character exceeds the limitation with respect to the length of the available label adhesion area of the selected concrete article for adhesion. Therefore, in the creation of the label for adhering to the concrete article for adhesion, when the number of the inputted characters is large with respect to the available label adhesion area of the concrete article for adhesion, it is possible to urge the user to restrict or limit the number of the characters to an appropriate number. In this manner, by causing the user to become aware that the number of the characters is larger than acceptable, there can be prevented a mistake in the label creation, i.e., a mistake in that the created label is too long as compared with the specific article for adhesion.

BRIEF DESCRIPTION OF THE DRAWINGS

FIGS. 2A and 2B are external perspective views with regard to the tape printer according to the embodiment of the present invention, in which FIG. 2A is an external perspective view of a tape cartridge, and FIG. 2B is an external perspective view when an open-close lid of the tape printer is open;

FIG. 5, divided into FIGS. 5A and 5B, is a list showing a part excerpted from menu items of a paragraph style setting menu according to the embodiment;

FIG. 6A is a list of a special form setting menu according to the embodiment, and FIG. 6B is a view showing letter (or font) sizes which are set when a fixed width printing is selected;

DESCRIPTION OF THE PREFERRED EMBODIMENTS

Hereinafter, referring to the accompanying drawings, a description of a tape printer according to an embodiment of the present invention will be made in detail.

Figure 1:
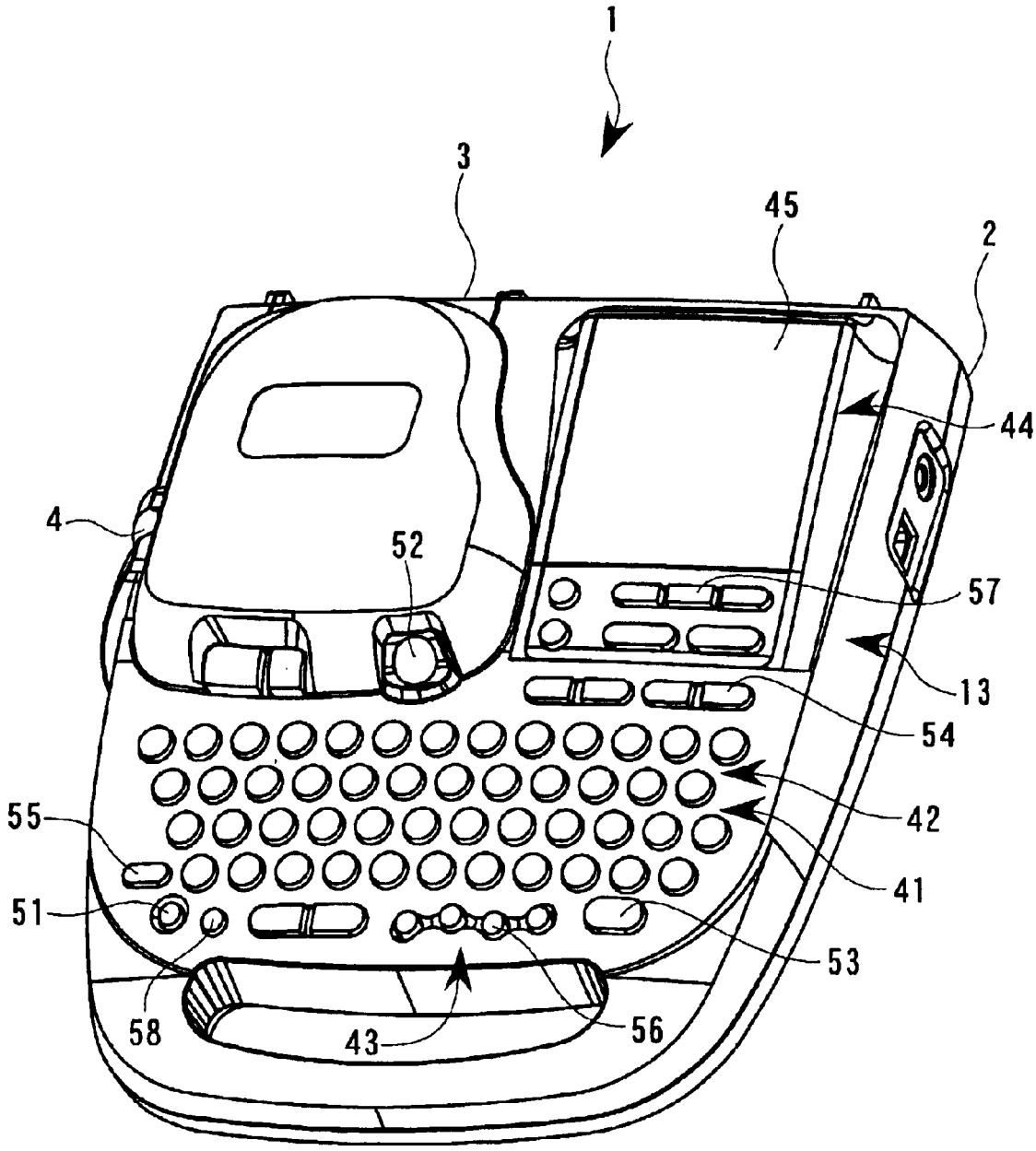
FIG. 1 is an external perspective view of a tape printer according to an embodiment of the present invention.
Figure 2A:
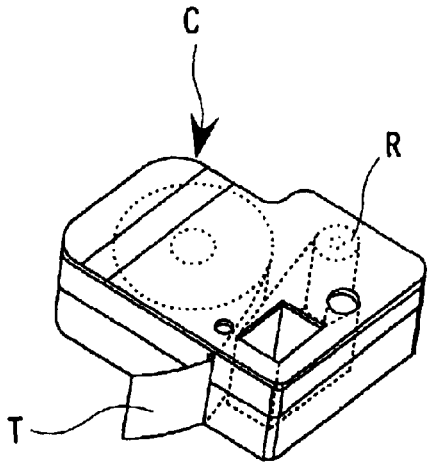
Figure 2B:
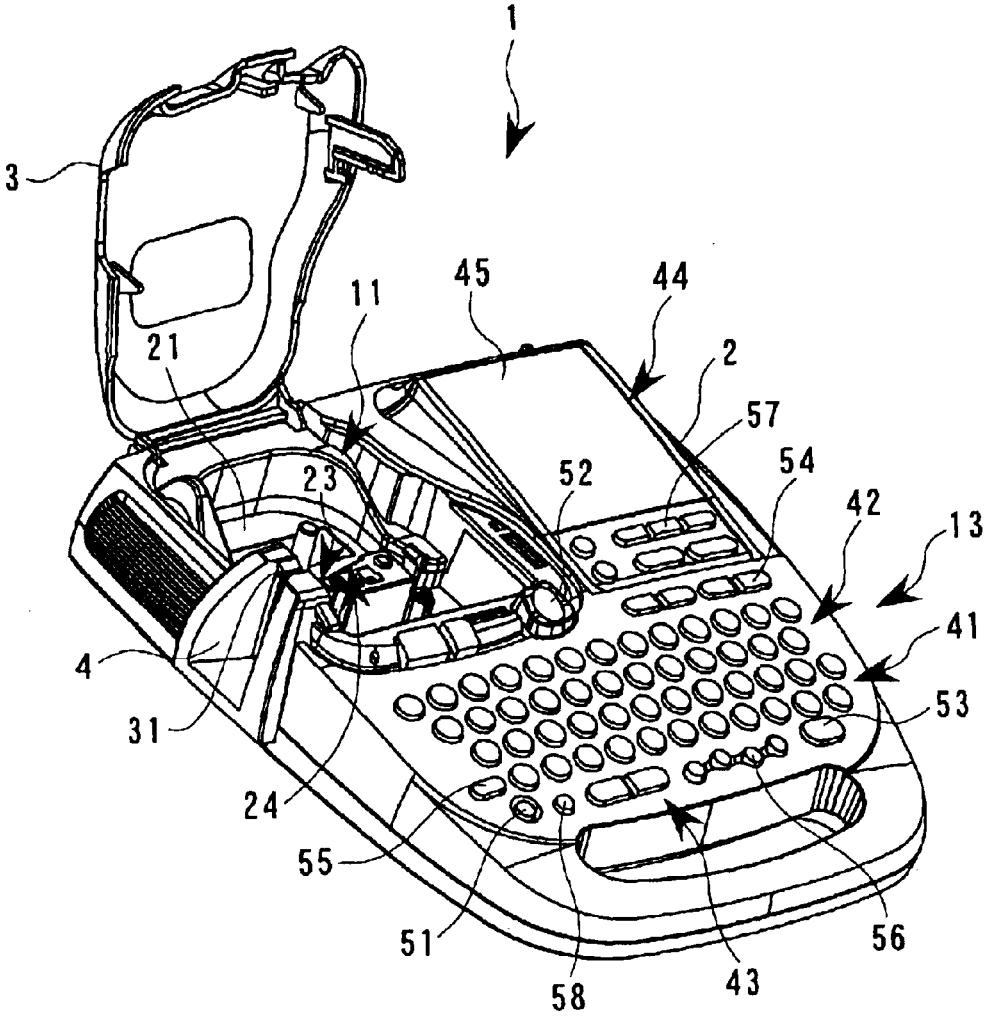

FIG. 1 is an external perspective view of the entire tape printer of the embodiment. FIG. 2A is an external perspective view of a tape cartridge which is loaded into the tape printer of the embodiment, and FIG. 2B is an external perspective view when an open-close lid of the tape printer of the embodiment is open. As shown in FIGS. 1 and 2B, the tape printer 1 is covered with a cover case 2. A pocket 21 for loading a tape cartridge C and a lid 3 thereof are provided on the left side at a rear part of an upper surface of the cover case 2. A keyboard 41 is provided on the front upper surface of the tape printer 1, and a display 44 is provided on the right next to the open-close lid 3. In addition, a tape discharging outlet 4 is formed on a left surface of the cover case 2 for discharging a printing tape T printed by the tape printer 1.

The tape printer 1 prints printing image data containing characters such as letters, numbers, and symbols by a printing unit 11 provided in the pocket 21 based on print information inputted from the keyboard 41, while letting the printing tape T out of the tape cartridge C. The tape printer 1 thus creates labels by sending the printed part of the tape from the tape discharging outlet 4. The printing tape T is then cut at a predetermined part by a tape cutter 31 provided in the tape discharging outlet 4. Note that, the respective parts of the tape printer 1 are controlled by a control unit 15 through various drivers in a drive unit 14 to be described later. The control unit 15 controls the entire tape printer 1 as well as the respective parts of the tape printer 1 independently.

Here, as shown in FIG. 2A, the printing tape T is housed in the tape cartridge C together with an ink ribbon R. The printing tape T is subjected to thermal transfer of characters from the ink ribbon R synchronously with drive of a printing head 24 (to be described later), and then is sent out of the tape cartridge C appropriately. Moreover, an adhesive surface which is covered with backing paper (release paper) is formed on the back surface of the printing tape T, so that the printing tape T can be adhered or adhered as a label to an article to which the label is adhered (this article is also referred to as an article for adhesion). In addition, various types of printing tapes T with different widths are prepared so as to be selectable depending on applications.

As shown in FIG. 2B, the printing unit 11 is made up of the pocket 21 for loading the tape cartridge C, a tape feeder 23 for feeding and sending the printing tape T from the tape cartridge C, and the printing head 24 which is covered with a head cover and which is formed of a thermal head. When the printing head 24 is driven to be heated up, characters such as letters are printed on the printing tape T. Here, a tape identification sensor 101 (not shown) for detecting the type (width) of the printing tape T is provided in the pocket 21.

An operation unit 13 includes the keyboard 41 composed of various keys, and the display 44 for displaying printing information. In the keyboard 41, a letter key group 42 which includes an alphabet key group, a symbol key group, a number key group, an external character key group for retrieving and selecting external characters, and the like are arranged. In addition, a function key group 43 for assigning various actions, and the like are also arranged in the keyboard 41.

The function key group 43 includes: a power key 51; a print key 52 for instructing a printing operation; a select key 53 for confirming data, starting a new line upon text input and instructing selection of various modes on a select screen; a cancel key 54 for canceling various instructions; a shift key 55 used for changing functions of the respective keys and the like; and four cursor keys 56 (56U, 56D, 56L, and 56R : "cursor (↑) key 56U") for moving a cursor in the upper (↑), lower (↓), left (←), and right (→) directions, respectively, and for moving the display area of the display screen 45. Moreover, the function key group 43 also includes a menu display key 57 for displaying a menu, an image key 58 for switching between a text entry screen and the display screen of the printing image data, and the like.

The display 44 has a rectangular shape with dimensions of 4 cm high×6 cm wide, and includes the display screen 45 capable of displaying 32 dots×64 dots display image data, and 18 indicators (not shown) for displaying various setting conditions. Moreover, the display 44 is used when the user inputs data, various instructions and the like by use of the keyboard 41 or when the user creates or edits the printing image data such as character sequence image data.

Figure 3:
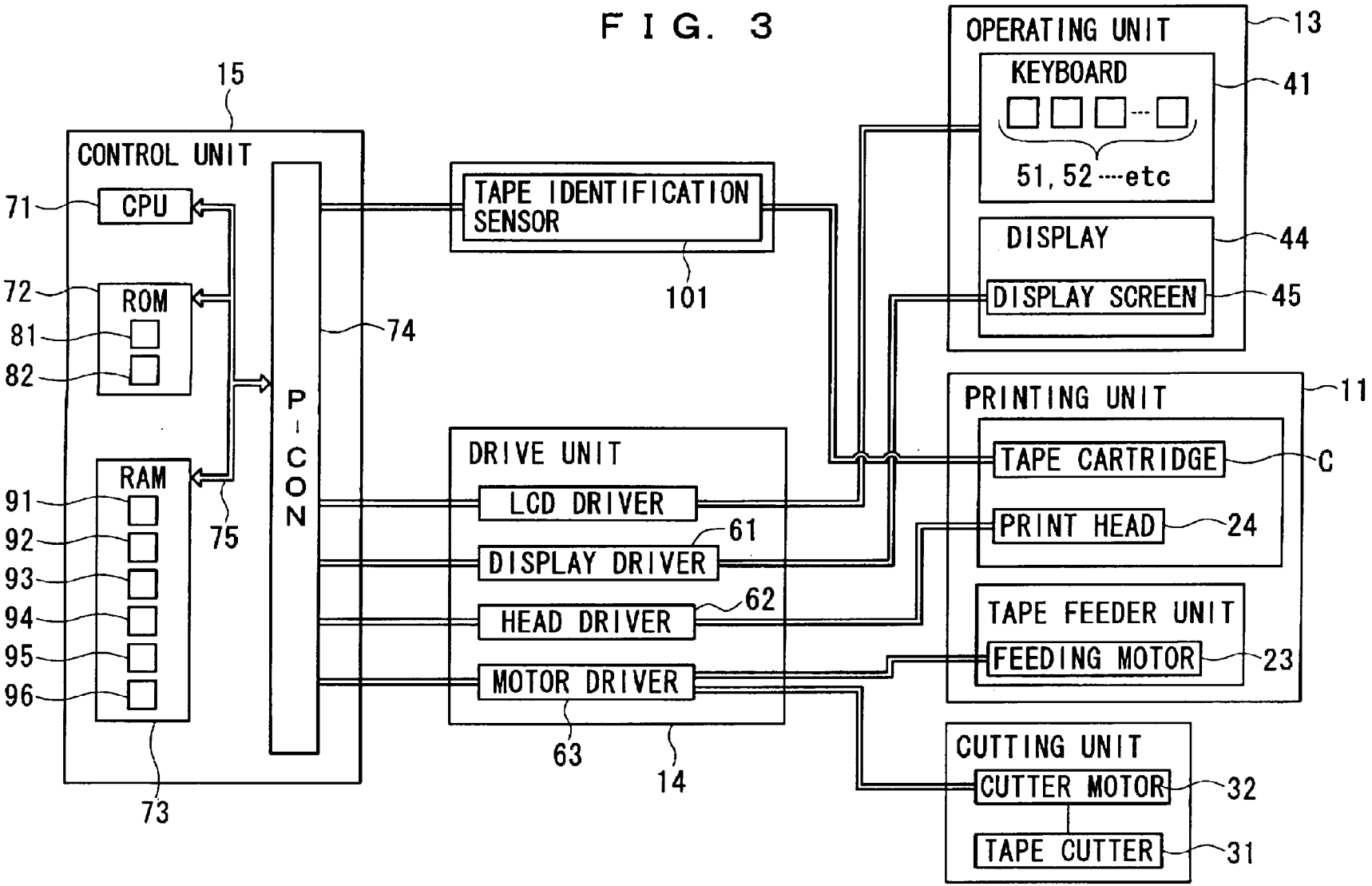
FIG. 3 is a block diagram of a control system of the tape printer according to the embodiment.

As shown in FIG. 3, the drive unit 14 drives the respective parts based on control signals outputted from the control unit 15. The drive unit 14 includes: a display driver 61 for driving the display 44; a head driver 62 for driving the printing head 24; and a motor driver 63 for driving various motors such as a cutter motor 32 which operates the tape cutter 31.

The control unit 15 is composed of digital integrated circuits. As shown in FIG. 3, a central processing unit (CPU) 71, a read-only memory (ROM) 72, a random access memory (RAM) 73, and a peripheral control circuit (P-CON) 74 are interconnected by an internal bus 75. The ROM 72 includes a control program area 81 for storing control programs to be processed by the CPU 71, and a control data area 82 for storing letter (or font) data prepared in the tape printer 1, such as letters, symbols, graphics and the like, and for storing control data such as a color conversion table or a letter modification table.

The RAM 73 receives power supply by a back-up circuit (not shown) so that stored data therein are retained if power is temporarily shut down by operating the power key 51 and the like. The RAM 73 includes a pictorial registration image data area 93, a printing history data area 94, and various conversion buffer area 95 such as other color conversion buffers, in addition to various register groups, a text data area 91 for storing text data such as letters inputted from the keyboard 41 by the user, a display image data storing area 96 for storing display image data of the display screen 45, and a printing image data storing area 92 for storing printing image data, which are collectively used as an operating area for control processing.

A logic circuit for supplementing functions of the CPU 71 and for handling interface signals with peripheral circuits is embedded in the P-CON 74. The P-CON 74 is connected to various sensors and the keyboard 41. Accordingly, the P-CON 74 takes various detection signals, various data and various instructions which are inputted from the keyboard 41 into the internal bus 75. The P-CON 74 further outputs the data and control signals, which are outputted from the CPU 71 or the like to the internal bus 75, toward the drive unit 14.

The CPU 71 processes various detection signals, various data, and various instructions inputted through the P-CON 74 in accordance with the control programs in the ROM 72, and then outputs the control signals to the drive unit 14 through the P-CON 74. In this way, the CPU 71 controls the entire tape printer 1.

Figure 4:
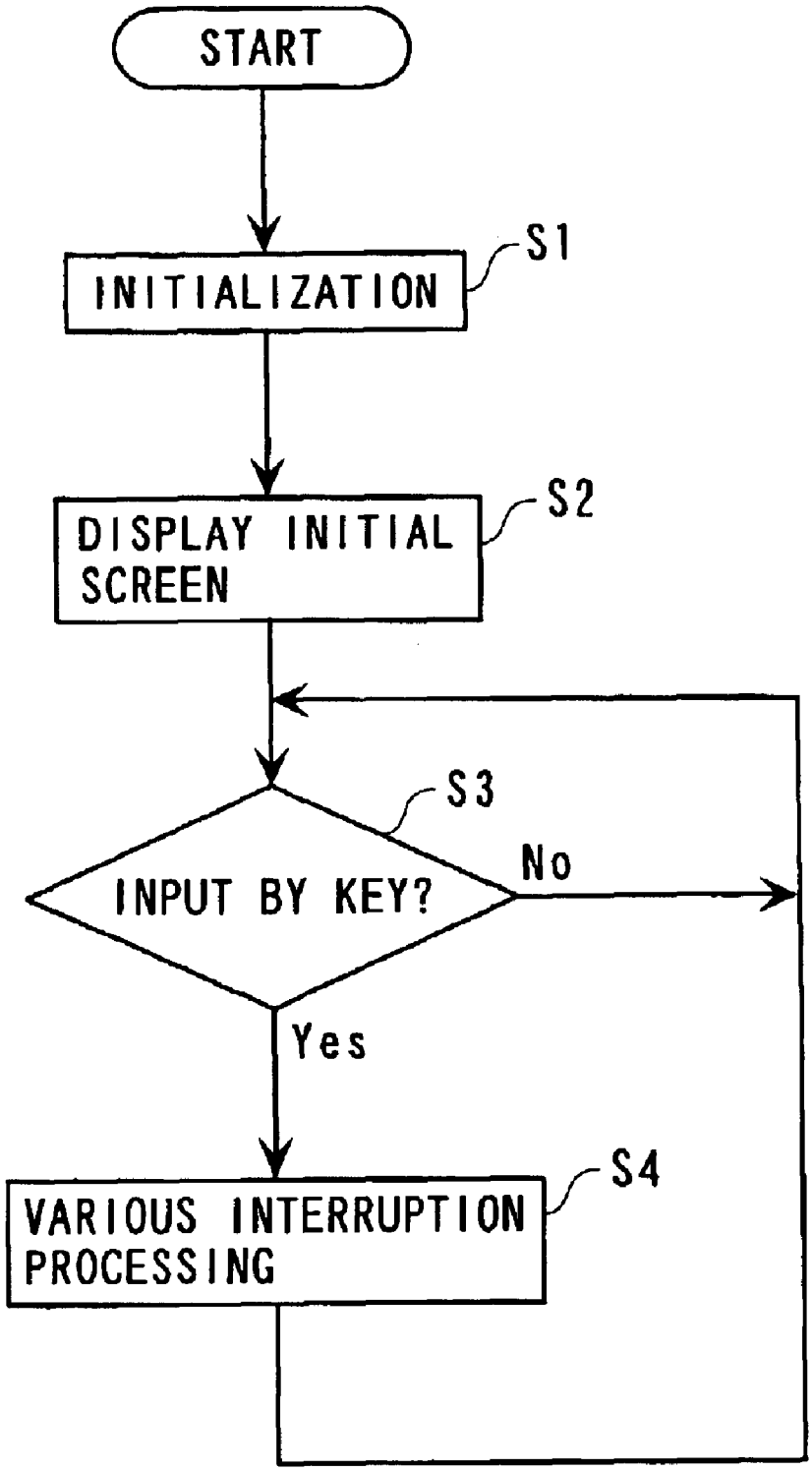
FIG. 4 is a flowchart showing a conceptual process of the entire control of the tape printer according to the embodiment.

Now, control processing of the tape printer 1 is mainly performed by interrupt handling. The user is able to freely select operation procedures for printing as long as creation or printing of the printing image data is ready. The entire processing flow of controlling the tape printer 1 will now be described with reference to FIG. 4. At the start of the processing by turning on the power or the like, initial setting is performed first to set the tape printer 1 back to a required initial state (S1). Then, an initial screen is displayed on the display screen (S2). When the initial screen display is completed and key input interruption is permitted, then a key input interruption stand-by condition is established (S3: No) and key input becomes feasible. When key input interruption occurs by key inputting (S3: Yes), then the processing moves to interrupt handling (S4). When interrupt handling is completed, then the key input interruption stand-by condition is reestablished (S3: No). Here, the branch judgment (S3) as to whether or not key input has taken place and various interrupt handling (S4) are conceptually indicated.

In the tape printer 1 of the embodiment, a paragraph style setting menu for setting the printing image data is prepared in order to create the labels which meet the user's purpose. In the paragraph style setting menu, in addition to the menu item which sets the printing image data in accordance with the width of the loaded tape, there is provided a menu item which corresponds to the specific article for adhesion, the article for adhesion requiring a label with a narrow width. Thus it is possible to create labels to be adhered to the specific article for adhesion (see FIGS. 5A, 5B and 8A, 8B). The paragraph style setting menu is displayed by pressing a menu display key 57.

As shown in FIGS. 5A, 5B (one table divided into two for want of the space) and 6A, the paragraph style setting menu includes a menu item "special form" which sets the form of the printing image data in accordance with the application of the labels, in addition to the three choices which are the menu items of "letter size" for setting a letter size (print size) of the printing image data, "allocation" for setting the layout of the printing image data, and "outer frame/table" for setting ornamental frame and table.

A description will be made with reference to FIGS. 5A and 5B. The menu items in the "letter size" include four menu items as level 2 (or a second hierarchy), i.e., a menu item "automatic" (automatic setting means) for automatically setting the letter size in accordance with the number of the inputted characters, a menu item "1 line (1 line of printing image data to be created)", a menu item "2 lines (2 lines of printing image data to be created)", and a menu item "3 to 8 lines (3 to 8 lines of printing image data to be created)" for setting the letter size of the printing image data to the letter size which was set in advance by selecting the number of lines of the printing image data to be created. In the menu items of the "1 line" and the "2 lines", a menu item is provided as level 3, which sets the letter size of the printing image data to a relative letter size in accordance with a width of the loaded printing tape T. In addition, especially in the menu item "1 line", the relative letter sizes can be set, as well as a menu item "fixed width" (fixed-size setting means) is provided. This menu item "fixed width" sets the letter size of the printing image data to the fixed size (specific print size) which corresponds to the specific concrete article for adhesion. When the article for adhesion is selected at level 4 after the "fixed width" has been selected, it is possible to set the letter size of the printing image data to an arbitrary fixed size by inputting the arbitrary letter size (numeric value) directly which is in a fixed size between a minimum size and a maximum size. The minimum size and the maximum size are determined based on a width D of the selected article.

For the "fixed width", it is possible to set the letter size of the printing image data without being influenced by the width of the printing tape T to be loaded since the letter size is able to be set to the fixed size corresponding to a concrete article for adhesion. Therefore, it is possible to set the letter size appropriate for the label for the concrete article for adhesion even if the printing tape T of any width is loaded. As shown in FIGS. 5A, 5B, in the tape printer 1 of the embodiment, a back of a flexible disk, a back of a magnet optical disk (MO), a back of a compact disk (CD) box, a back of a mini disk, and a pencil are set as the concrete articles for adhesion. Moreover, "FD back", "MO back", "CD box", "MD back", and "pencil" are respectively provided as menu items. In addition, the concrete media which are most likely to have labels created for them are partly listed up above as the concrete articles for adhesion in the present embodiment. They are, of course, not limited to these examples but a memory stick, a SmartMedia, and cases in which these media are contained may also be included therein.

A menu item "outer frame/table" is one for setting the ornamental frame and the table for all of the inputted characters. When the selection of the outer frame and the table are made in the menu item "outer frame/table" after "fixed width" is selected at level 3 of "letter size" and the concrete article for adhesion is selected at level 4, a guide line is set based on a width D. The width D is a width of the edge face, to which the article for adhesion is adhered, the article being selected at level 4 of the menu item "letter size".

As shown in FIG. 6A, the menu item "special form" is one for setting the form of the printing image data in accordance with the label application. The "special form" includes a menu item "fixed width printing" for creating the label which is adhered to the concrete articles for adhesion ("FD back", "MO back", "CD box", "MD back", and "pencil") which are set in the fixed-size setting menu (fixed width) in addition to menu items, i.e., "header/longitudinal", "header/transversal", "longitudinal horizontal writing", and "transversal vertical writing". When level 2 or less is selected from the "special form" and when the specific application is selected, the display screen is switched to the exclusive input screen corresponding to the application selected (i.e., to the input screen that is exclusively prepared for the selected application).

When the concrete article for adhesion is selected from the "fixed width printing", the display screen is switched to the exclusive input screen corresponding to the concrete article for adhesion, and the letter size of the printing image data is set to the fixed size (specific print size) based on selected article as shown in FIG. 6B. Namely, if the "fixed width printing" is used, the letter size of the printing image data is set to the letter size suitable for the label of the selected article by just selecting the article. In the exclusive input screen, the number of the letters capable of being inputted is limited depending on the length L of the available label adhesion area of the concrete article for adhesion, and when the number of the inputted letters exceeds the limitation, an error display is made. Moreover, in the "fixed width printing", not only is it possible to set the letter size of the printing image data, but also is it possible to automatically insert into the printing image data pictographic characters indicating or implying the concrete article for adhesion.

As described above, the paragraph style setting menu includes the menu item for creating the label which corresponds to the width of the printing tape T, and the menu item for creating the label for specific concrete article for adhesion such as the flexible disk and the magnet optical disk (MO), thus enabling the user to select appropriate items according to his/her needs.

Figure 7:
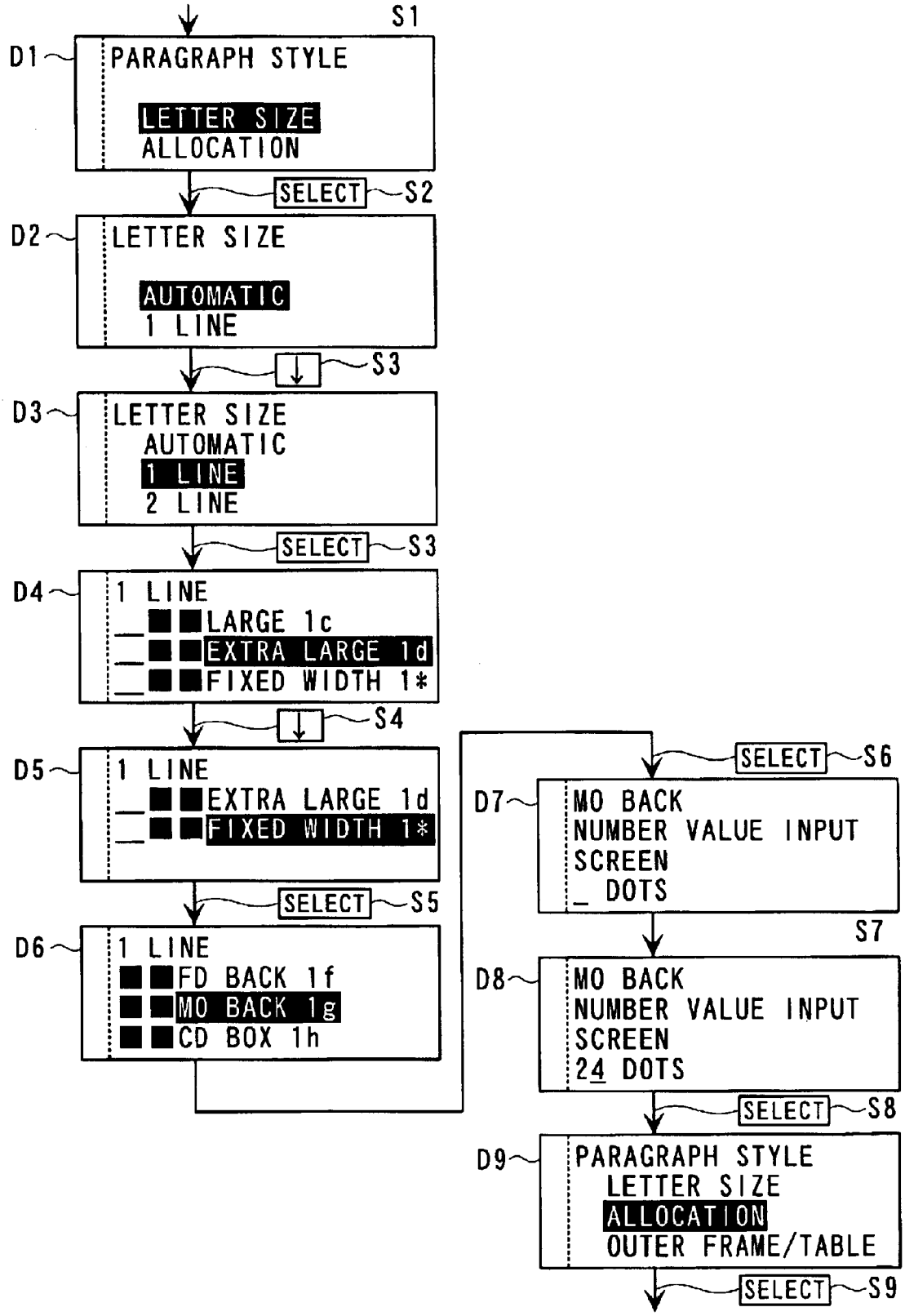
FIG. 7 is a diagram showing display screens and an operation flow when the letter size is set to the fixed width in the tape printer according to the present invention.
Figure 8A:
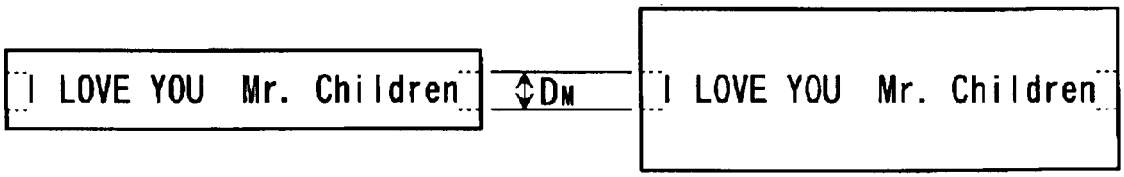
FIGS. 8A and 8B are views showing labels created by the tape printer of the embodiment.
Figure 8B:
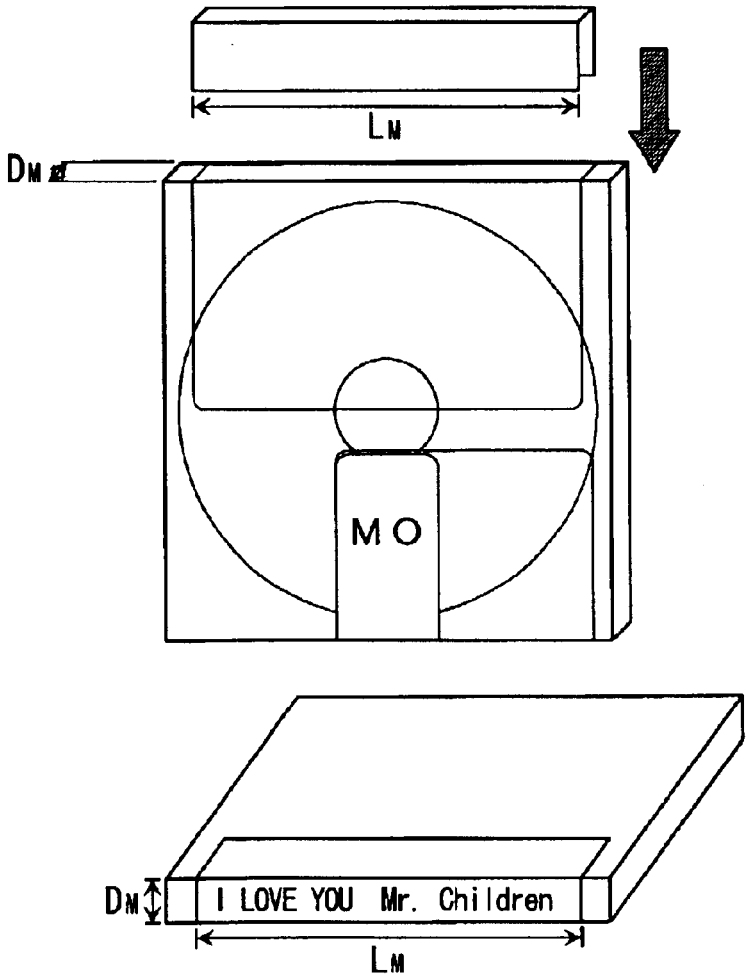

Here, a method of creating the printing image data will be described in concrete, by taking as an example a method of creating the label adhered to the back of the magnetic optical disk (MO). As shown in FIG. 7, first, when the menu display key 57 is pressed (S1), the "letter size" menu item at level 1 is highlighted (in a state reversed to black) and also the "allocation" menu item is displayed on the display screen 45 (D1). The highlight indicates an input temporary confirmed state of the menu item, and when the selection key 53 is pressed in a state in which the menu item is highlighted, the input of highlighted menu display is confirmed. In addition, the highlight can be moved to the other menu items in the same level corresponding to those other than the aforementioned menu item by operating the cursor keys 56 U/D (↑), (↓).

When the selection key 53 is pressed in a state in which the menu item "letter size" is in the highlight (a state reversed to black) (S2), and the menu item "letter size" is selected, the menu items "automatic", "1 line", and "2 lines" of level 2 which correspond to "letter size" are displayed (D2). When the input confirmation is made (S4) after the menu item "1 line" is highlighted (D3) by operating the cursor keys 56 U/D (↑)(↓) (S3), level 3 corresponding to the menu item "1 line" is displayed (D4). After the menu item "fixed width" is highlighted (D5) by operating the cursor keys 56 U/D (↑)(↓) (S5), the menu items of the level 4 is displayed (D6) by confirming the input with the selection key 53 (S6), whereby "MO back" is selected (S7). In the menu items of level 3, the menu items other than "fixed width" (for example, "small", "medium", "large", and "extra large") are relative character sizes, and the letter size of the printing image data is set in accordance with the width of the loaded tape T.

When the menu item "MO back" is selected at level 4, the display screen is switched to the input screen of the printing image data letter size for a label which is to be adhered to the back of the MO (D7). When a numeric value is inputted for the letter size (S8), the numeric value inputted is displayed on the display screen (D8), and when the selection key 53 is pressed (S8), the letter size of the printing image data is set to the inputted letter size (print size). The numeric value which can be inputted is within the range between the minimum value and maximum value of the letter size determined based on a width $D_M$ of the back of the MO which is an edge face of the article for adhesion. When a numeric value outside the range is inputted, an "error" is displayed.

When the setting of the letter size has been completed, the display screen 45 once again displays the menu items of level 1 in the paragraph style menu, and then the setting of the layout position, the outer frame and the like of the printing image data can be performed. When the outer frame or the table is selected from the menu item "outer frame/table" after the letter size of the printing image data is set to the fixed character size, the guide line based on the width $D_M$ of the back of the MO is set. It is thus possible to print the guide line which can be used as a guide when the label is adhered to the MO.

Characters such as letters and numerals which are to be printed on the label are inputted after the printing image data setting is completed, and the print key 52 is then pressed to execute printing. Here, the characters of the inputted fixed character size are printed on the printing tape T irrespective of the width of the loaded printing tape T. Accordingly, the label to be adhered to the back of the MO is created (see FIG. 8A, which shows a title of a song by a singer group called "Mr. Children"). When the created label is wider than the width $D_M$ of the MO back, the label is adhered thereto in a folded manner in line with the width $D_M$ of the MO back (see FIG. 8B).

Figure 9:
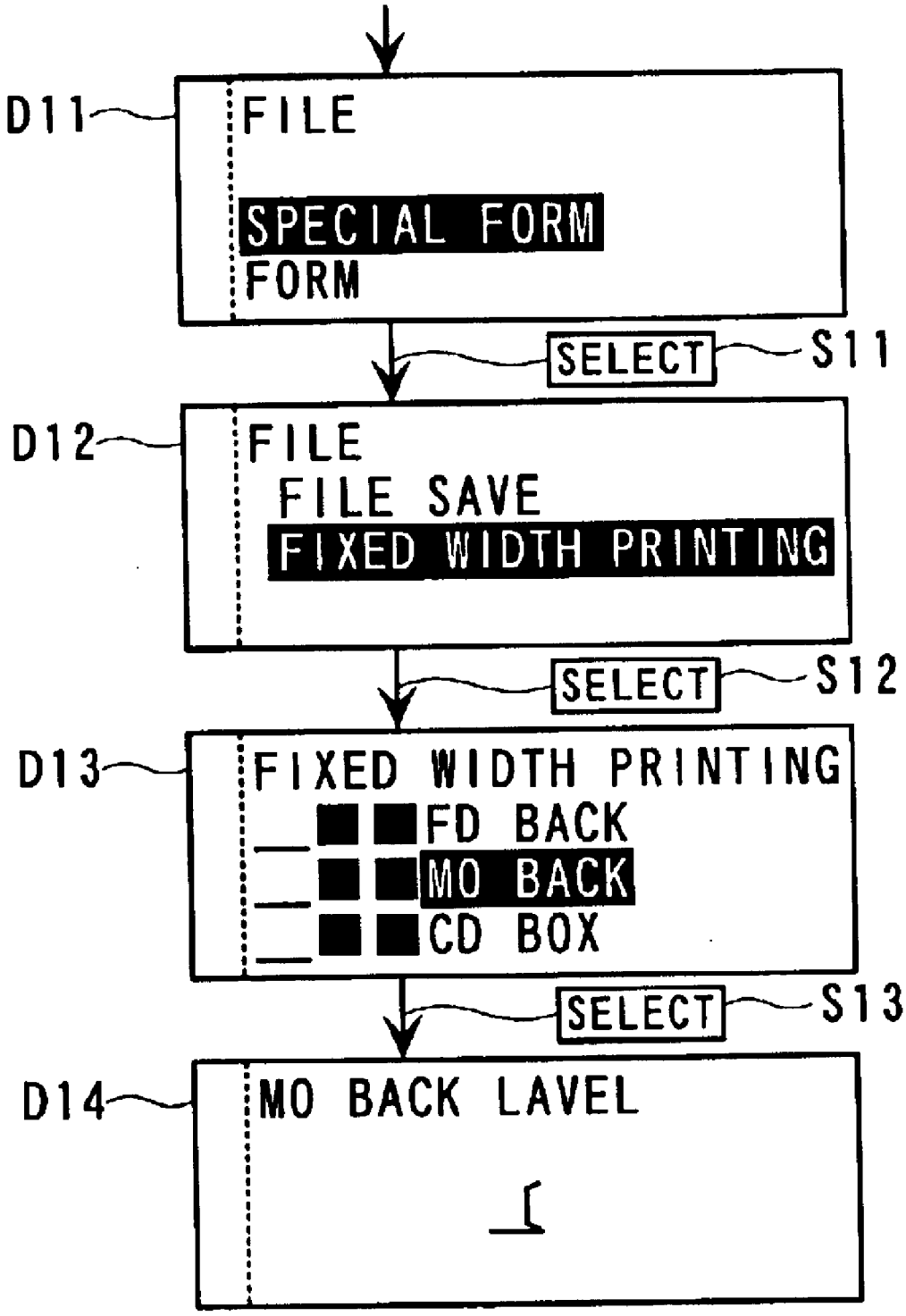
FIG. 9 is a diagram showing display screens and an operation flow when the fixed printing setting is performed from a special form in the tape printer of the embodiment.

The label to be adhered to the back of the MO can also be created from the menu item 'special form" in substantially the same method as the method described above. A description thereof will be made with reference to FIG. 9. Level 1 of the paragraph style menu (D11) is displayed, then "special form" is selected, and the "fixed width printing" and the "MO back" are selected in the second and the third levels, respectively by the cursor keys 56 U/D (↑)(↓), and the selection key 53 (D12 to D13, S12–S13).

When the "MO back" is selected at level 3, the letter size of the printing image data is set to the fixed character size (16 dots) which corresponds to the width $D_M$ of the MO (see FIG. 6B), and the display screen 45 is switched to "MO back label" for creating the label to be adhered to the back of the MO (D14). A state is thus obtained in which the character input of letters, numerals, and symbols or the like is enabled. Then, after the characters are inputted, the print key 52 is pressed, whereby the characters suitable for the width $D_M$ of the MO are printed (see FIGS. 8A, 8B). However, the number of the characters is limited based on the length $L_M$ of the available label adhesion area of the MO. The error display is generated in case where the entire length of the characters of the printing image data (characters for printing) exceeds the length $L_M$ of the available label adhesion area of the MO, the available adhesion area substantially corresponding to more than two lines. Then, when the printing is performed in a state in which the error display has been generated, the "fixed width printing" is ignored and a relative letter size is set in accordance with the number of the lines of the printing image data.

As described above, the printing apparatus and, in particular, the tape printer of the present invention include setting device, or automatic setting means for setting the print size of the printing image data automatically in accordance with the width of the loaded printing tape, and fixed-size setting device, or fixed-size setting means for creating the label for the specific article. Therefore, the user can create the label in accordance with the width of the printing tape, and create the label for the specific article easily and rapidly irrespective of the width of the loaded printing tape, whereby the convenience of the tape printer can be enhanced.

What is claimed is:

1. A tape printer for printing characters on a printing tape for use as a label to be adhered to an article for adhesion, comprising:

display means for displaying on a screen characters inputted into the tape printer;

print means for printing the inputted characters on the printing tape;

automatic setting means for automatically setting a print size of the characters according to a tape width of a loaded printing tape; and selection setting means for selectively setting the print size of the characters from among a pulraity of print sizes determined in stages, wherein the selection setting means comprises fixed-size setting means capable of selectively setting a specific print size corresponding to an article for adhesion selected from among a plurality of concrete articles for adhesion.

2. The tape printer according to claim 1, wherein the plurality of concrete articles for adhesion include media, cases for containing therein these media, and a pencil, the concrete media including those classified into a magnetic disk, an optical magnetic disk, an optical disk, and a memory card.

3. The tape printer according to claim 1, wherein the display means switches an input screen to an exclusive input screen corresponding to the concrete article for adhesion by mode switching to the fixed-size setting means.

4. The tape printer according to claim 1, wherein the specific print size corresponds to an end face of the concrete article for adhesion, and wherein the print means is capable of printing a guide line corresponding to a width of the end face of the article for adhesion as well as the characters of the specific print size.

5. The tape printer according to claim 1, wherein the print means prints pictographic characters implying the concrete article for adhesion as well as the characters of the specific print size.

6. The tape printer according to claim 1, wherein the fixed-size setting means comprises a character number limiting means for limiting a number of the inputted characters depending on an available length of an adhesion area of the concrete article for adhesion.

7. The tape printer according to claim 6, wherein the character number limiting means notifies an error in the display means when the number of the inputted characters exceeds a limitation.

* * * * *